US005515907A

United States Patent [19]

Boenisch

[11] Patent Number: 5,515,907

[45] Date of Patent: May 14, 1996

[54] METHOD OF AND APPARATUS FOR REGENERATING FOUNDRY SAND

[76] Inventor: Dietmar Boenisch, Emmi-Welter Str. 8, D52064 Aachen, Germany

[21] Appl. No.: 96,655

[22] Filed: Jul. 22, 1993

[30] Foreign Application Priority Data

Jul. 24, 1992 [DE] Germany ..... 42 24 493.5
May 12, 1993 [DE] Germany ..... 43 15 893.5

[51] Int. Cl.[6] ..... B22C 5/10; B22C 5/18

[52] U.S. Cl. ..... 164/456; 164/5; 164/150.1; 164/154.1; 241/DIG. 10

[58] Field of Search ..... 164/456, 4.1, 5, 164/150.1, 154.1, 155.1, 412; 241/DIG. 10

[56] References Cited

U.S. PATENT DOCUMENTS 3,600,574 8/1971 Glaza et al. ..... 164/5 X
4,436,138 3/1984 Kondo ..... 164/5
4,709,862 12/1987 Leidel ..... 164/5 X
5,045,090 9/1991 Pohl ..... 164/5 X

FOREIGN PATENT DOCUMENTS 2856536 10/1979 Germany ..... 164/5
53-35622 4/1978 Japan ..... 164/5
60-92041 5/1985 Japan ..... 164/456
1006036 3/1983 U.S.S.R. ..... 164/5

*Primary Examiner*—J. Reed Batten, Jr.
*Attorney, Agent, or Firm*—Cohen, Pontani, Lieberman, Pavane; Christa Hildebrand

[57] ABSTRACT

Used foundry sand is regenerated with dust removed by controlled air flow from the moving sand. The density of the dust in the outgoing air is monitored while the sand is regenerated and the monitored results are utilized as control data for the regeneration.

20 Claims, 3 Drawing Sheets

METHOD OF AND APPARATUS FOR REGENERATING FOUNDRY SAND

BACKGROUND OF THE INVENTION

Used foundry sand is regenerated to remove such foreign matter as bentonite, synthetic resin, particles of coal and coke, etc. and convey them away pneumatically. These substances are either purposely added or occur on their own during casting. The regenerated sand is as good as new and can even be employed in cores. The process is carried out in a regenerator with a downstream separator. Dust released in the regenerator is extracted continuously or discontinuously with at last one current of air and transferred to the separator, where it is intercepted and precipitated. The dust can be precipitated altogether or class by class, depending on the type of separator.

Known regenerators operate in accordance with various principles. Some include rotating drums. The drums may accommodate turbulators or similar components. Others feature mechanical beaters, centrifugal scrubbers, fluidizers, and stationary abraders. The separators are usually cyclones with fine-dust filters downstream.

One substance that is particularly difficult to remove is bentonite. It can account for 30% and even more of the mass of the used sand. Bentonite is present in different states that require different strategies to remove. The substance occurs in recirculating molding sands in iron-and-steel foundries in two forms, active and hard. Active bentonite is needed to bind the sand in the mold. Hard bentonite on the other hand is ballast material. The heat of the molten metal destroys its binding power, and it usually bakes in the form of a shell around each grain of sand. This process is often called ooliting. Hard bentonite shells must be either cracked open by knock or impact in order to regenerate the sand or ground by powerfully abrading the particles together. In the latter approach the edges of the particles will simultaneously be rounded off, which is an advantage.

Removing the residual active and refractory bentonite, coal dust, and core binder during regeneration overtaxes many regenerators. The sand will either take too long to regenerate or will be left so contaminated as to be useless. It has been demonstrated that the synthetic-resin binders employed in most contemporary cold-box or hot-box processes must include essentially less than 0.5% residual dust by mass. Otherwise, the regenerated sand must be refreshed with a lot of new sand, and too much resin will have to be added. These techniques need to be eliminated as much as possible for economical and environmental reasons.

Research demonstrates that the composition of used sand can extensively change so rapidly that even the parameters of a regenerator at the same foundry will frequently have to be revised. The revisions, however, may be wrong if the precise situation is not known. It has for example been discovered that the composition of used sand obtained at different times from the same point in the same foundry can differ so extensively that some can take as little as 20 minutes and some as much as 80 minutes to regenerate satisfactorily. Still, foundries lack testing facilities that will provide the necessary data rapidly enough to appropriately tailor a regeneration in process. Regeneration in this case is accordingly conducted for 30 minutes with abrasion force and dust removal maintained at constant levels. The result is poor regeneration, unnecessary energy consumption, and low output.

Foundry sands differ from batch to batch due to their varying ratios of mold sand to core sand and in accordance with how much heat they take. Requirements, however, will also vary while one and the same charge is being regenerated. Much of the failure that occurs in the regeneration of foundry sands derives from setting such parameters as machinery-operating times, processing rates, impact and abrading forces, and dust-removal rates at unvarying averages. The consequences are uneconomical operation and poor regeneration accompanied by defective cores and castings. Another aggravation is that current machinery is not designed or manufactured to individually or interactively adjust to necessary momentary variations in the abrading and dust-removal situation.

SUMMARY OF THE INVENTION

One object of the present invention is a simple and economical method of regenerating used foundry sand in regenerators that the dust is pneumatically removed from.

This object is attained in accordance with the invention in that the density of the dust in the dust-removing air is constantly monitored while the sand is being regenerated and the results forwarded as signals for controlling the regeneration.

The method in accordance with the invention allows automation of both the method and the device. Both will automatically adjust to the moment-by-moment exigencies of regeneration. The measuring instrument's sensors are accommodated directly upstream of or within the outgoing-air flue. They measure the density of dust in the air on its way to a separator and transmit the results continuously or discontinuously to overall controls. Sensors that measure temperature and moisture for example may also be present depending on the type of regenerator employed. The overall controls, which preferably include a fuzzy-logic processor, process the results and actuate the regenerator's various subsidiary controls. Signals can also be used to control a separator and regenerated-sand conveyor downstream of the regenerator and a used sand inlet gate upstream thereof.

Tests of an abrader-based regenerator indicate that the abrasion of hard bentonite is impeded in the initial phase of the process by the presence of a lot of extremely fine active bentonite dust. The dust consists of resilient flakes that act like a lubricant. Coal dust has similar properties. These constituents of the dust must be initially eliminated and removed while the dust density is being monitored and before the abrasion is in full operation. Since some of these substances are detrimental in the core sand and beneficial in the mold sand, they are intercepted and extracted for re-use as useful powdered products. It makes no sense to start abrading until the density of the dust in the outgoing-air flue decreases. Abrasion is accompanied by formation of a dust that cannot be exploited by current technologies. This approach both optimizes and extensively accelerates regeneration, decisively increasing both quality and economics and decreasing the waste that is so difficult for the foundry industry to dispose of.

The quality of the regenerated sand is extensively determined by how much dust it still contains, which should be as close to zero as possible. Regeneration accordingly terminates in accordance with the invention with a stage of fine-dust removal and with abrasion almost discontinued to prevent the occurrence of more dust. The batch is not released for automatic removal until the sensor indicates almost no dust in the air.

The present art offers several means of measuring dust density. One is a light barrier comprising a source that transmits a beam of light to a photocell. Variations in the intensity of the light due to dust in the outgoing air flowing through the barrier trigger the regenerator's controls. Since very little light can get through to the cell when there is a lot of dust in the air, it makes sense to employ less but proportional dust traveling through a bypass for the sensing. Dust must be kept off lenses, cells, and other components of the sensor by continuously sweeping them with clean air. It makes sense to adjust the amount of dust-removing air to the sensitivity of the sensing process, which also helps measure the density of dust in the outgoing air.

Other means of measuring dust density involve infrared, ultrasonic, capacitative, and conductivity measurements in the flow of dusty air. It can also be of advantage to apply various measurements simultaneously or sequentially. Measuring the transmission of ultrasound is more sensitive at high densities and measuring that of visible light at low densities. Isotopic and radioactive tracers can also be employed to measure the density of the dust. Since active bentonite also contains electrolyte, tests that address the latter can be employed to determine the substance's level in the flow of outgoing air.

Not all the sand recirculated within a foundry always needs to be extensively regenerated. A much less regenerated sand can be employed for example as green sand or cold-set resin bonded core sand than as polyurethane cold-box or hot-box core sand. The latter processes require cleaner sands. In practice accordingly, regeneration is allowed to proceed only until the sand is clean enough for the particular purpose it is being employed for. Different types of regenerator are also employed for different types of sand and can even be combined into multiple-stage sand-regeneration systems (Giesserei 76, 1989, 10/11, 350–58). The level of regeneration achieved at various stages in existing systems is unknown, and the products can often be insufficiently regenerated and defective. They are accordingly sometimes regenerated further than necessary, which takes time and energy and unnecessarily increases waste.

The density of the dust in the dust-removing air at least one stage of a multiple-stage sand-regeneration system is accordingly measured in accordance with the invention, and the results are forwarded as signals for controlling that stage and/or a preceding stage and/or a subsequent stage. To optimize the results the dust density can be measured at each stage and the results employed to control that stage and to transfer the sand from one stage to the subsequent stage.

BRIEF DESCRIPTION OF THE DRAWINGS

Two embodiments of the invention will now be specified with reference to the drawing, wherein.

DESCRIPTION OF THE PREFERRED EMBODIMENTS

Figure 1:
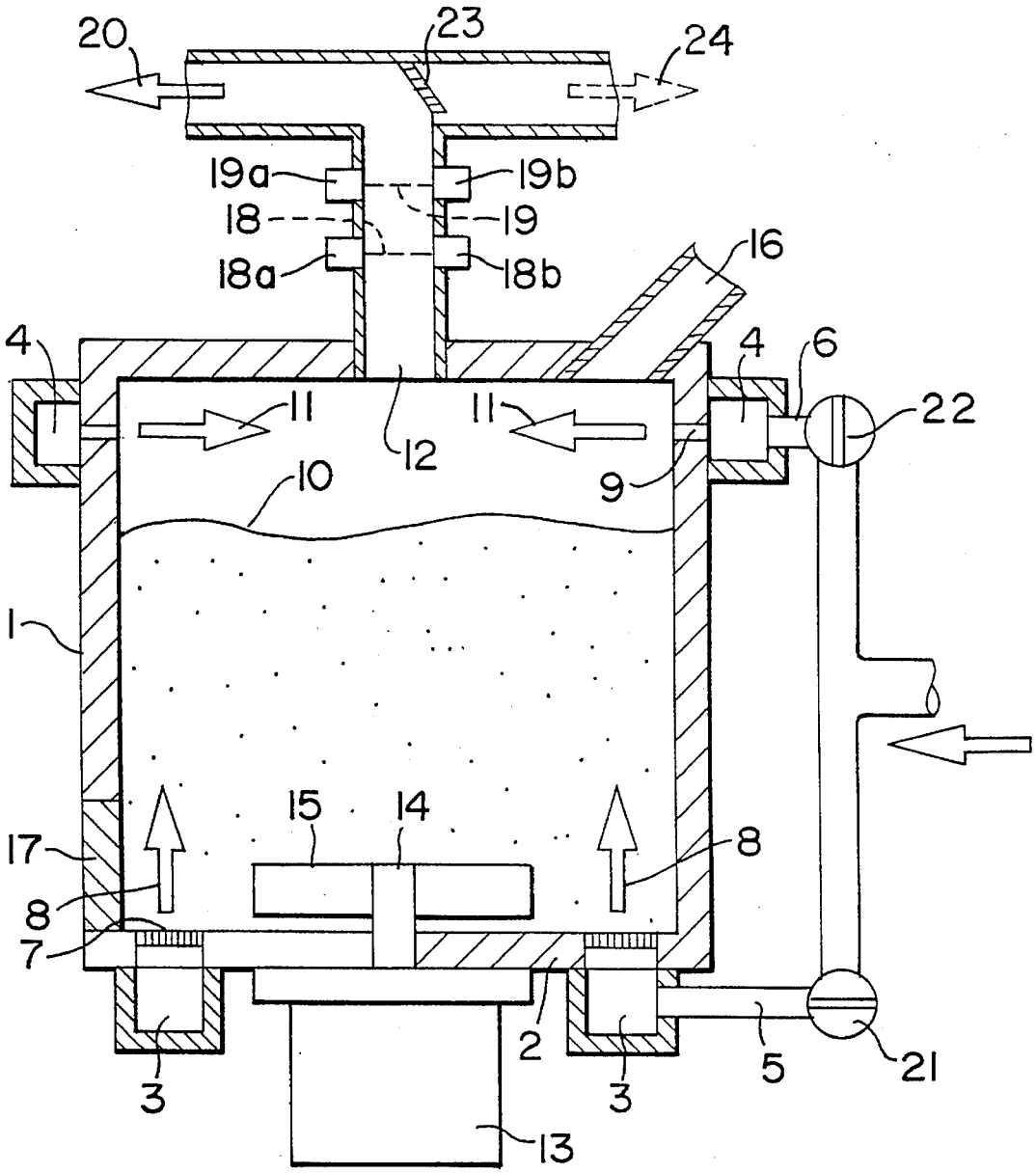
FIG. 1 illustrates a regenerator in the form of a sand-abrading machine for carrying out the method in accordance with the invention.

The regenerator schematically illustrated in FIG. 1 essentially comprises a box 1 with a bottom 2. A centripetal-air supply ring 4 extends along the outer surface of the box's wall and an axial-air supply ring 3 is mounted against the outer surface of bottom 2. Lines 5 and 6 supply dust-removal air to air chambers 3 and 4. The air is conveyed by vacuum or pressure. Draft air is injected into box 1 through gratings 7 distributed along axial-air supply ring 3. Transverse air is injected from centripetal-air supply ring 4 through intakes 9 above the level 10 of the sand in box 1.

The draft air, represented by arrows 8, intercepts the foreign particles abraded off the used sand and forwards it through outgoing-air flue 12 to an unillustrated separator in the form for example of a cyclone and fine-mesh filter. The transverse air, represented by arrows 11, also enters outgoing-air flue 12, where it augments the extraction of dust when draft air 8 is too weak to carry the coarser particles of dust to the separator. A variable-speed motor 13 at the center of bottom 2 rotates an abrading disk 15 mounted on a shaft 14. Used sand is introduced through an opening-and-closing intake 16 until it reaches level 10. Regenerated sand is removed through a port 17.

The outgoing dusty air flows through a dust-density measurement point in the form of a light barrier 18 constituted by sensor **18*a* and 18*b* and through another dust-density measurement point in the form of an ultrasound barrier 19 constituted by sensor 19*a* and 19*b* in outgoing-air flue 12. The sensitivity of light barrier 18 differs from that of ultrasound barrier 19. They can act simultaneously or sequentially. Outgoing-air flue 12 and box 1 can also accommodate other, unillustrated sensors that measure temperature and moisture during the process. The mechanisms can also include an adjustable deflector plate 23**.

The results deriving from the sensors are processed in a learning-capable computer by fuzzy logic. The computer accommodates for this purpose an integrated fuzzy-logic processor, a Fuzzy 166 or higher for example.

The flow of air 8 through box 1 from air chamber 3 is regulated by a regulator 21 and the flow of transverse air 11 from air chamber 4 by a flow regulator 22 such that the sum of both remains approximately constant throughout the regeneration. The advantage is that the flow of dusty air through light barrier 18 and ultrasound barrier 19 will remain nearly constant and the density of the dust will be unaffected by how much air is supplied. Compensation would be necessary otherwise.

The signals from light barrier 18 and ultrasound barrier 19, modified in accordance with the density of the dust in the outgoing air, are utilized by central controls to govern the speed of the motor 13 that drives abrading disk 15 and to open and close flow regulators 21 and 22. The rates of abrasion and dust removal can accordingly be varied independently, which ensures flexibility and allows regeneration to be varied in accordance with the prevailing conditions. The beginning and end of the process can also be established by the mechanisms that open and close used sand intake 16 and regenerated-sand extraction port 17. Sometimes a lot of active bentonite and coal dust rubs off before the actual high-abrasion phase and must be intercepted separately for re-use. In this event, the same signals can be exploited to actuate deflector plate 23 and divert the flow of outgoing air through outgoing-air flue 12 to one of two different connections 20 and 24 each leading to an associated separator.

Figure 2:
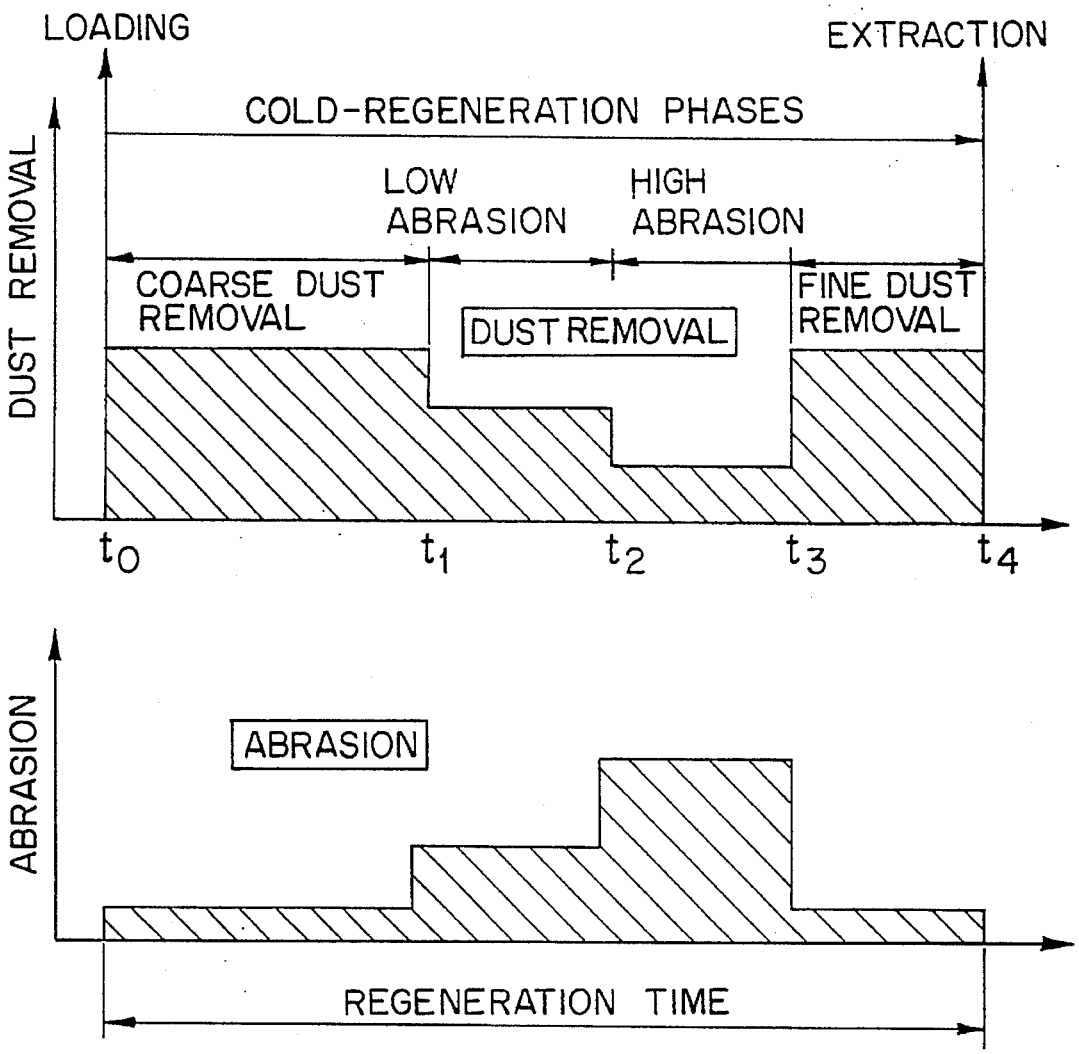
FIG. 2 is a graph of the various stages involved in regenerating a batch of sand.

FIG. 2 illustrates how the method in accordance with the invention can be adapted to regenerating a foundry sand that contains large quantities of bentonite. The overall process is divided into several intervals of time dictated by sensors **18*a* and 18*b* and 19*a* and 19*b***.

Abrading disk 15 initially rotates slowly, functioning strictly as an agitator at this stage of the process. Flow regulator 21 is open and flow regulator 22 closed. A lot of air flows through the column of used sand and preferably intercepts and entrains useful substances. Deflector plate 23 diverts the outgoing dusty air to connection 20. The useful precipitated substances can be re-used in the mold sand. The dust contains a lot of active bentonite and of lustrous carbon formers like coal dust. During the interval $t_0$ to $t_1$, which experience demonstrates to be long, only a little power is required and there is little wear on the machinery, which contributes to the method's economy. If the light barrier 18 in outgoing-air flue 12 detects low dust density, the controls will automatically increase the speed of abrading disk 15 and pump less draft air 8 through, supplementing it with centripetal air 11. During the resulting low-abrasion phase $t_1$ to $t_2$, any active bentonite adhering to the grains of sand will continue to be abraded off and removed along with more and more refractory bentonite, residual core binders, and other ballast. Reversing damper 23 to open outgoing air connection 24 is now recommended. As soon as the sensors detect that the dust density is decreasing again, the controls initiate a high-abrasion phase $t_2$ to $t_3$, during which the major mass of the refractory-bentonite shells and the edges and corners of the grains of sand are abraded off. The abrading disk is now decelerated and the flow of axial air accelerated by light-barrier sensor **18*a* and 18*b***, initiating the particularly important phase $t_3$ to $t_4$ of fine-dust removal. This phase terminates at time $t_4$ with extraction of the regenerated sand. Time $t_4$ differs with the type of sand and must be precisely determined to ensure high-quality products, as the method in accordance with the invention does.

The regenerator accordingly operates through several phases that depend on the density of dust in the outgoing air. The duration and abrasion rate of each phase depends on the amount and hardness of the foreign matter baked onto or adhering to the grains of sand, on how much sand is in the box, and on the efficiency of the regenerator.

The process can be either discontinuous as illustrated in FIG. 2 or, when fuzzy logic is involved, continuous. Although the method in accordance with the invention is particularly effective for used sands containing bentonite, it can also be employed for regenerating mold sands that contain only synthetic resin.

Figure 3:
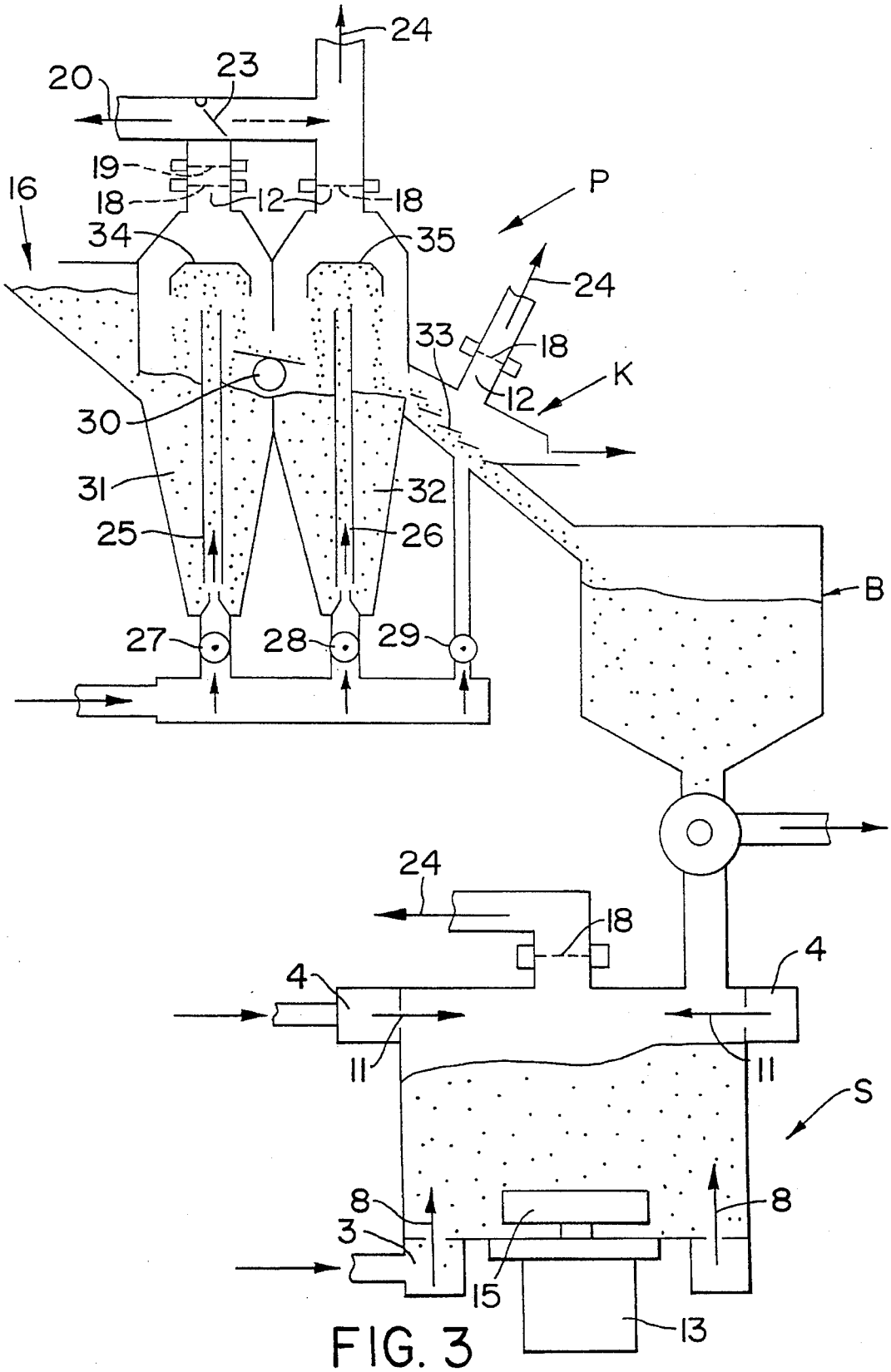
FIG. 3 illustrates a multiple-stage sand-regeneration system.

The impactor P schematically illustrated in FIG. 3 comprises two cells 31 and 32. Section 31 accommodates a blast tube 25 and section 32 a blast tube 26. Air is supplied to blast tube 25 through flow controls 27 and to blast tube 26 through flow controls 28. The cells communicate through a motorized adjustable deflection plate 30. A cascade sifter K is supplied with air through flow controls 29. Cell 31, cell 32, and cascade sifter K each has its own outgoing-air line 12, accommodating a point 18 that measures the density of the dust in the outgoing air flowing through it. Above the dust-density measurement point 18 in the outgoing-air line 12 leaving first section 31 is another dust-density measurement point 19 with sensors that detect the presence of useful substances in the outgoing air and emit signals that actuate a deflector plate 23, diverting the air back and forth between outgoing air connections 20 and 24. Cascade sifter K has a mechanism 33 for separating oversize from the other sand. The oversize is forwarded to an unillustrated bunker. The regenerated sand of medium quality is loaded into a hopper B, whence it can be directly obtained as needed or forwarded to an abrader-based regenerator S for additional processing.

Preconditioned used sand is added to initial cell 31 through inlet gate 16. The sand is blasted at low power against a concave target 34. The deflector plate 23 is in the illustrated position, diverting the airborne dust to a useful-substance collector. The dust is mainly coal dust and active bentonite. When the sensors at dust-density measurement point 19 detect the presence of no active bentonite or of very little in relation to the total amount of dust measured by the sensors at upstream dust-density measurement point 18, deflector plate 23 reverses position and establishes communication with a connection 24 that leads to a collector for waste material.

The pneumatic impact regenerator can be operated continuously or batch by batch. When the dust density measured in the air leaving initial cell 31 drops below a prescribed threshold, transfer mechanism 30 enters a state that allows more sand into subsequent cell 32. In this section it is blasted more powerfully against another target 35. The supply of air, however, is limited to a level ensuring that, although the foreign matter adhering to the grains is loosened and released to a greater extent, the grains themselves are not broken up. To keep the wear of the sand low, more foreign matter is accepted on the surface of the grains of sand conveyed to cascade sifter K. More dust and oversize is eliminated from the sand in cascade sifter K. Now free of loose dust, the sand can be directly employed for hot-box or cold-set resin-bonded cores or to replenish mold sand. When the regenerated sand is to be employed for cores with sensitive binders that require almost new sand quality, it will need to be re-regenerated in abrading regenerator S additionally. Regenerator S can also be employed to monitor hard bentonite and/or other foreign matter residue left on the grains by subjecting them to a brief high-abrasion treatment, of 5 seconds for example. This feature is useful for example for evaluating regenerated sand qualities with respect to various application purposes and in relation to binder consumption.

When a particularly small and compact regenerator is needed, the impact regenerator can have a flat bottom with at least one abrasion disk rotating above it and between the blast tubes. Preliminary regeneration can be carried out in apparatus other than impact regenerators. Dust density can alternatively be measured in bypasses.

I claim:

1. A method of regenerating foundry sand in a regenerator by pneumatic dust removal, comprising the steps of:

moving foundry sand in the regenerator, supplying a flow of air through and above the moving sand, measuring the density of dust in air generated by the moving sand to obtain a measured density value, and utilizing the measured density value as a control signal for controlling at least one of the moving of sand and the supplying of air.

2. The method of claim 1, further comprising a step of precipitating the dust separately into useful substances and waste in accordance with the duration of regeneration and the measured density value.

3. The method of claim 1, further comprising the steps of:

measuring the temperature of the foundry sand to obtain a measured temperature value, and utilizing the measured temperature value as a signal for controlling at least one of the moving of the sand and the supplying of air.

4. The method of claim 3, further comprising the step of processing the control signals by fuzzy logic to control at least one of the moving of the sand and the supplying of air.

5. The method of claim 1, further comprising the steps of:

measuring the temperature of the sand to obtain a measured temperature value, and adding the measured temperature value to the control signal.

6. The method of claim 1, further comprising the steps of:

measuring the moisture of the foundry sand to obtain a measured moisture value, and adding the measured moisture value to the control signal.

7. A method of regenerating foundry sand in a multiple-stage sand-regeneration system comprising the steps of:

moving foundry sand to be regenerated, supplying air through and above the moving sand, measuring the density of dust generated by the moving sand in the air in one stage of the multiple stage system, to obtain a measured density value, and forwarding the measured density value for controlling the movement of sand and supply of air in the one stage.

8. The method of claim 7, further comprising the steps of:

measuring the dust density at each stage of the multiple stage system to obtain measured dust density values for each respective stage, utilizing each of the measured dust density values to control at least one of a preceding and subsequent stage, and controlling the transfer of the sand from one stage to the subsequent stage.

9. The method of claim 7, further comprising the step of separately controlling the amount of air supplied to each stage.

10. The method of claim 7, further comprising a step of supplying a short high-abrasion phase to determine an amount of foreign matter adhering to the grains of sand.

11. A foundry sand regenerator comprising:

a box containing foundry sand to be regenerated, means for moving the sand contained in said box, an air-supply system for providing air through the sand and above the sand, at least one outgoing-air line for removing dust, at least one air-density-control sensor in the area of the outgoing-air line for measuring the density of the dust and connected for controlling said means for moving, said air supply system and said outgoing-air line based upon the measured density.

12. The regenerator of claim 11, further comprising an electrical connection between the air-density-control sensor and the air supply system to control the air supply.

13. The regenerator of claim 11, further comprising an electrical connection between the air density-control sensor and the means for moving the sand to control the motion of the sand.

14. The regenerator of claim 12, wherein the connection for control includes a microprocessor with a fuzzy stage.

15. The regenerator of claim 11, wherein the air-density-control sensor is a light barrier.

16. The regenerator of claim 11, wherein the air-density-control sensor is a ultrasound barrier capacity sensor.

17. The regenerator of claim 11, wherein the air-density-control sensor is a conductivity sensor.

18. A multiple-stage regenerating system, comprising:

a plurality of cells containing sand to be regenerated, an air-supply system for providing air through the sand contained in each of said plurality cells, at least one outgoing-air line for removing dust from a respective one of said plurality of cells, at least one deflector plate in the at least one outgoing-air line, and at least one air-density-control sensor in said at least one outgoing-air line for measuring the density of the dust in the outgoing air and controlling said air-supply system and at least one deflector plate based upon the measured density.

19. The multiple-stage regenerating system of claim 18, further comprising an electrical connection between the sensor and the at least one deflection plate for controlling the at least one deflector plate.

20. The multiple-stage regenerating system of claim 18, further comprising an electrical connection between the sensor and the air-supply system for controlling the air-supply.

* * * * *